US006886506B1

(12) United States Patent
Hubbell et al.

(10) Patent No.: US 6,886,506 B1
(45) Date of Patent: May 3, 2005

(54) PRESSURE REGULATOR WITH OVERMOLDED POPPET

(75) Inventors: James C. Hubbell, Fond du Lac, WI (US); Steven W. Habeck, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 66 days.

(21) Appl. No.: 10/423,306

(22) Filed: Apr. 25, 2003

(51) Int. Cl.[7] ..... F02M 41/00
(52) U.S. Cl. ..... 123/41.74
(58) Field of Search ..... 123/41.08–41.82 R; 277/600–601; 137/625.48

(56) References Cited

U.S. PATENT DOCUMENTS

| | | | | | |
|---|---|---|---|---|---|
| 2,782,801 | A | * | 2/1957 | Ludwig | 137/625.48 |
| 3,918,418 | A | | 11/1975 | Horn | 123/41.08 |
| 5,048,468 | A | * | 9/1991 | Broughton et al. | 123/41.74 |
| 5,588,202 | A | | 12/1996 | Ehlers et al. | 29/606 |
| 5,937,802 | A | | 8/1999 | Bethel et al. | 123/41.74 |
| 6,116,884 | A | | 9/2000 | Rowley et al. | 425/111 |
| 6,481,418 | B1 | | 11/2002 | Ristich et al. | 123/457 |
| 6,523,380 | B1 | | 2/2003 | McGuire et al. | 70/408 |
| 6,537,853 | B1 | | 3/2003 | Johnson et al. | 438/112 |

* cited by examiner

*Primary Examiner*—Marguerite McMahon
(74) *Attorney, Agent, or Firm*—William D. Lanyi

(57) ABSTRACT

A cooling system for an internal combustion engine of a marine propulsion system is provided with a poppet that is overmolded with a resilient sealing material to enhance its sealing capacity. As a result, the pressure within the internal combustion engine cooling passages can be maintained more accurately. Because undesirable leakage past the poppet is more successfully prevented by the overmolded poppet, the cooling system can more accurately regulate the temperature of the engine.

14 Claims, 4 Drawing Sheets

PRESSURE REGULATOR WITH OVERMOLDED POPPET

BACKGROUND OF THE INVENTION

1. Field of the Invention

The present invention is generally related to a pressure controlling device for an internal combustion engine and, more particularly, to a poppet that is overmolded to provide an improved sealing surface so that cooling water within an internal combustion engine of a marine propulsion system can be more accurately controlled.

2. Description of the Prior Art

It is well known to those skilled in the art that it is beneficial to regulate the pressure within the cooling system of an internal combustion engine in addition to regulating the temperature.

U.S. Pat. No. 5,937,802, which issued to Bethel et al on Aug. 17, 1999, discloses an engine cooling system which is provided with coolant paths through the cylinder block and cylinder head which are connected in serial fluid communication with each other. In parallel with the cooling path through the cylinder head, a first drain is connected in serial fluid communication with a pressure responsive valve and the path through the cylinder block. A temperature responsive valve is connected in serial fluid communication with the cylinder head path and in parallel fluid communication with the first drain. A pump is provided to induce fluid flow through the first and second coolant conduits and the first and second drains, depending on the pressure responsive valve and the temperature responsive valve.

U.S. Pat. No. 6,481,418, which issued to Ristich et al on Nov. 19, 2002, describes a fuel pressure regulator. A fuel pressure regulator for supplying fuel to the intake of an internal combustion engine at a substantially constant pressure is provided. The fuel pressure regulator includes a housing defining a fuel chamber in fluid communication with a fluid inlet. The housing further includes a fuel outlet opening in fluid communication with the fuel chamber. The housing defines a seating surface around the outlet opening. A valve body is moveably disposed within the housing and moves between open and closed positions. The valve body contact and seals against the seating surface and prevents fuel flow through the outlet opening when the valve body is in the closed position. The valve body is biased into the closed position. The valve body includes an extension with at least a portion thereof disposed in the fuel outlet opening to guide the valve body.

U.S. Pat. No. 3,918,418, which issued to Horn on Nov. 11, 1975, discloses a marine engine cooling system employing a thermostatic valve means and a pressure relief valve means. A pressure relief valve for an engine of an outboard motor includes a valve plate connected to a stem and spring loaded water cooling passageway in closed spaced relation to a thermostatically controlled valved passageway. The stem extends outwardly through a water discharge chamber directly in communication with the discharge passageway to the lower unit of the motor. A diaphragm is connected to the out end of the valve stem and is sealed to form a wall of the water discharge chamber. The discharge chamber is normally under a slight water discharge pressure whenever the thermostatic valve is open and thus creates a very slight pressure on the diaphragm which is balanced by the closure spring until such time as the pump pressure within the cooling system is sufficient to overcome the force of the spring. As the relief valve opens, the internal passageway pressure is transmitted to the discharge chamber. This results in the diaphragm rapidly moving outwardly and establishing the full open position of the relief valve. This, in turn, results in a reduction of the internal passageway pressure.

The technique of overmolding an object with either plastic or an elastomeric material is well known to those skilled in the art. Various techniques and processes have been developed to perform this overmolding procedure. In addition, many different objects have been manufactured through the use of an overmolding process.

U.S. Pat. No. 6,537,853, which issued to Johnson et al on Mar. 25, 2003, describes an overmolding encapsulation process. A method of encapsulating an article having first and second surfaces, including positioning the articles on a carrier such that at least a portion of the first surface contacts the carrier is described. A portion of the carrier carrying the article is then positioned within a mold and a seal is formed between the mold and the carrier. The mold is then filled with an encapsulating material to form a seal between the article and the carrier.

U.S. Pat. No. 5,588,202, which issued to Ehlers et al on Dec. 31, 1996, discloses a method for manufacturing an overmolded sensor. A method is described for manufacturing a plurality of proximity sensors which are attached to a printed circuit board during the manufacturing steps and subsequently severed from the printed circuit board by shearing. Each of the proximity sensors comprises a core and coil assembly, a plurality of electronic components and an electrical connector. These components of each of the proximity sensors is encapsulated during an overmolding process and the encapsulations are removed from the printed circuit board by a shearing step. Each of the encapsulations can be inserted into a cylindrical housing.

U.S. Pat. No. 6,523,380, which issued to McGuire et al on Feb. 25, 2003, describes an overmolded key including an ornamental element and method of making same. A vehicle ignition key having an ornamental element molded onto the key is described. The key includes a key blank and an undermold which is formed by molding a first plastic material over a portion of the key blank, defining a mounting surface for the element. The ornamental element is located on the mounting surface and secured to the heel portion of the key blank by an overmold which is formed by molding a second plastic material over the heel portion of the key blank, the undermold, and at least a portion of the element. In one embodiment, the overmold material covers substantially the entire peripheral edge of the element.

U.S. Pat. No. 6,116,884, which issued to Rowley et al on Sep. 12, 2000, describes a mold core for overmolded flexible valves. A mold core is provided for producing an overmolded flexible valve. The mold core comprises a mold body, a piston assembly, a piston retaining means, a collet bit positioning means and at least two collet bits. The mold core has a cylindrical void in a distal end and has a pressure means communicated with the cylindrical void. The piston assembly has a piston head sized and adapted for axial movement in the cylindrical void, with a piston shaft extending axially from the head. The shaft is tapered from a larger first diameter at one end to a smaller second diameter at the other end. The piston retaining means has a bore through it to allow insertion of the piston shaft. Each of the at least two collet bits has an inner cylindrical tapered surface segment, the taper of the surface segment being essentially the same as the taper of the piston shaft, and an out cylindrical surface segment, sized and adapted to be inserted inside the flexible valve. The at least two collet bits are positioned adjacent to the tapered portion of the shaft. The collet bits are positioned by the collet bit positioning means.

The patents described above are hereby expressly incorporated by reference in the description of the present invention.

If the poppet does not successfully prevent the flow of coolant from the cooling passage to the drain passage when the pressure within the cooling passage is less than a predetermined threshold magnitude, cooling liquid will flow out of the cooling passage and be replaced by colder cooling fluid. In a marine propulsion system, the replacement liquid is water from a body of water in which a marine vessel is operating. Typically, this water is much colder than the water within the cooling passage as the internal combustion engine operates.

In cases where the poppet does not properly seal to block the conduit, the engine operates at a temperature which is less than the optimal, or desired, temperature. Therefore, it is important to make sure that the poppet properly seals the conduit when the coolant in the cooling passage is at a pressure less than the preselected pressure for which the pressure regulating device was chosen. It would therefore be significantly beneficial to the operation of a marine engine if a poppet could be provided which assures proper sealing of the conduit when the coolant pressure is less than the predetermined pressure.

SUMMARY OF THE INVENTION

An engine cooling system, made in accordance with the preferred embodiment of the present invention, comprises a cooling passage formed within an internal combustion engine. It also comprises a drain passage and a conduit disposed in fluid communication between the cooling passage and the drain passage. A poppet, which is moveable relative to the conduit between a first position and a second position, is also provided. A liquid coolant is generally prevented from flowing through the conduit when the poppet is in the first position. The liquid coolant is generally permitted to flow through the conduit when the poppet is in the second position. A pressure regulating device is associated with the poppet to urge the poppet into the first position. A resilient sealing surface is overmolded on a sealing portion of the poppet.

The pressure regulating device can be a metal spring and the poppet can comprise the sealing portion and an insertion portion, wherein the insertion portion is disposed within the conduit to assist in aligning the poppet during its movement between the first and second positions. The sealing portion of the poppet can be a flange extending from a body of the poppet.

The resilient sealing surface can be formed on two surfaces of the flange of the poppet but, in a preferred embodiment, it is formed on three surface of the flange. The conduit is generally circular in cross-section and the sealing portion of the poppet is generally circular in cross-section. The sealing portion has a greater radius than the conduit.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
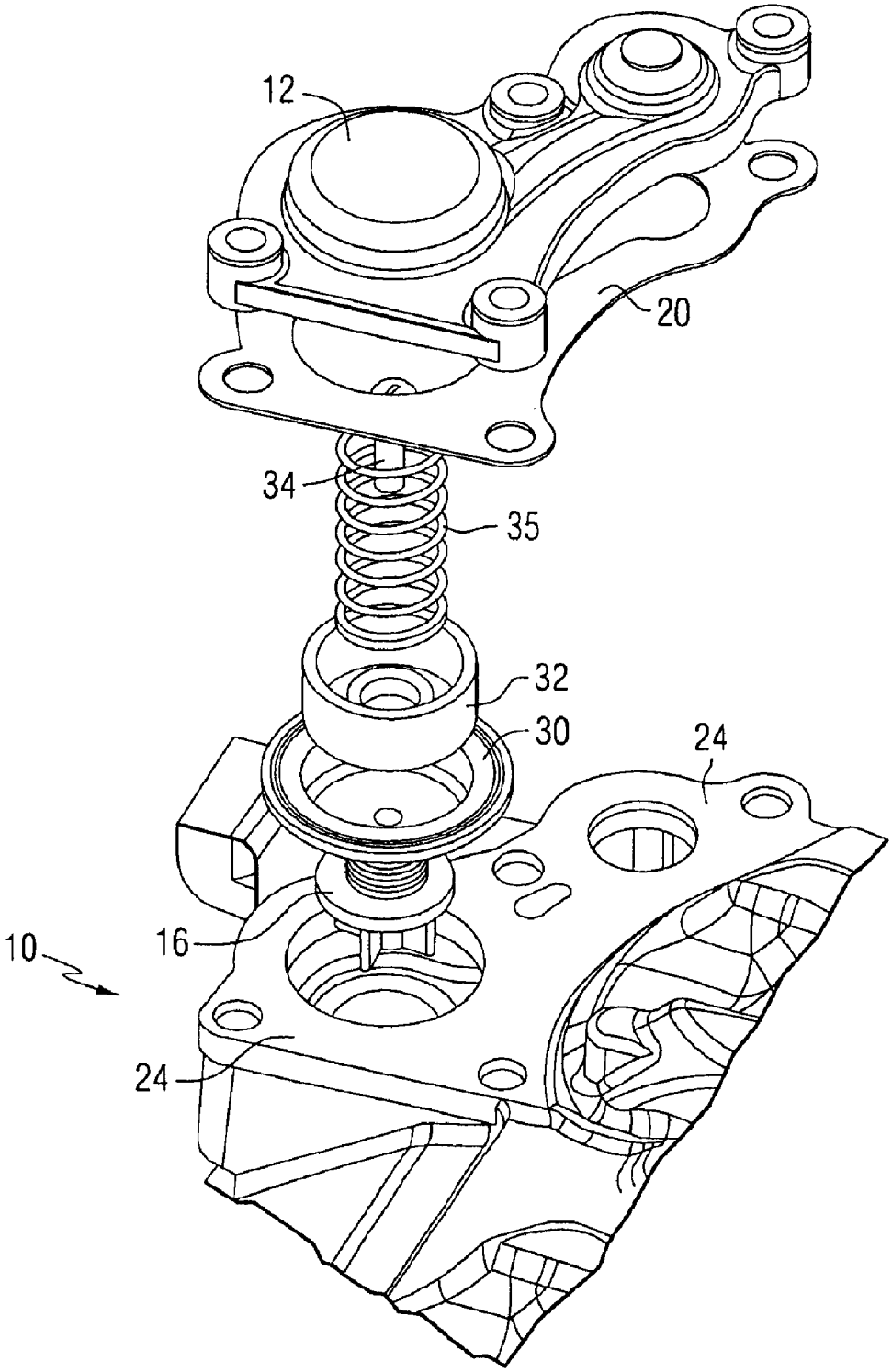
FIG. 1 is an isometric exploded view of a portion of an internal combustion engine for a marine propulsion device.

Throughout the description of the preferred embodiment of the present invention, like components will be identified by like reference numerals.

FIG. 1 is an exploded isometric view of an internal combustion engine 10 with its poppet structure exploded away from their mounting location. A cover 12 is shaped to contain the poppet 16 of the present invention. A gasket 20 is used to provide a seal between the cover 12 and its associated mounting surface 24.

With continued reference to FIG. 1, a diaphragm 30 is used in conjunction with a washer 32, a screw 34, and a spring 35. The spring 35 maintains a force against the poppet 16 which urges it into its first position or sealing position.

Figure 2:
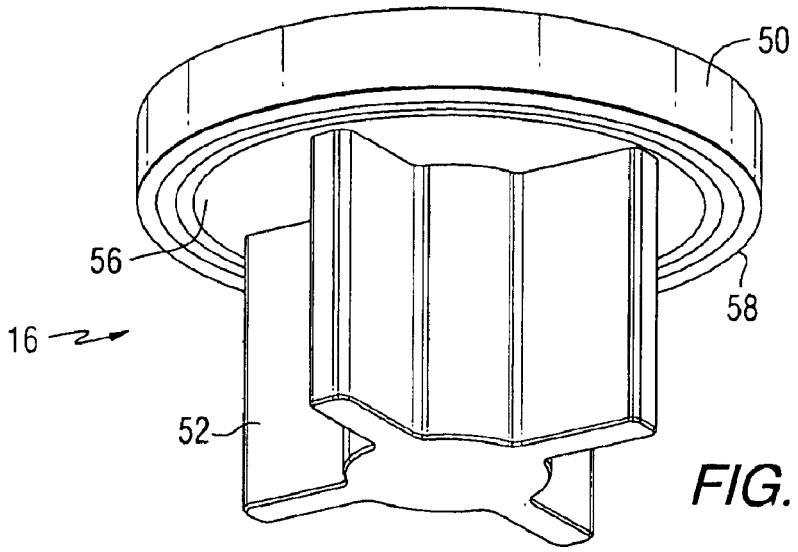
FIG. 2 is an isometric view of a poppet made in accordance with the present invention.

FIG. 2 is an isometric view of the poppet 16 made in accordance with the preferred embodiment of the present invention. The poppet has a sealing portion 50 and an insertion portion 52. The sealing portion 50 comprises a flange 56 that extends radially from the body of the poppet 16. A resilient sealing material 58 is overmolded around the flange 56 that extends from the body of the poppet 16. It is resilient and, in a preferred embodiment of the present invention, is made of Santoprene 101-73 which is available in commercial quantities. It should be understood that the sealing material 58 is overmolded and attached to three surfaces. This can be seen in the section view illustrated in FIG. 3.

Figure 3:
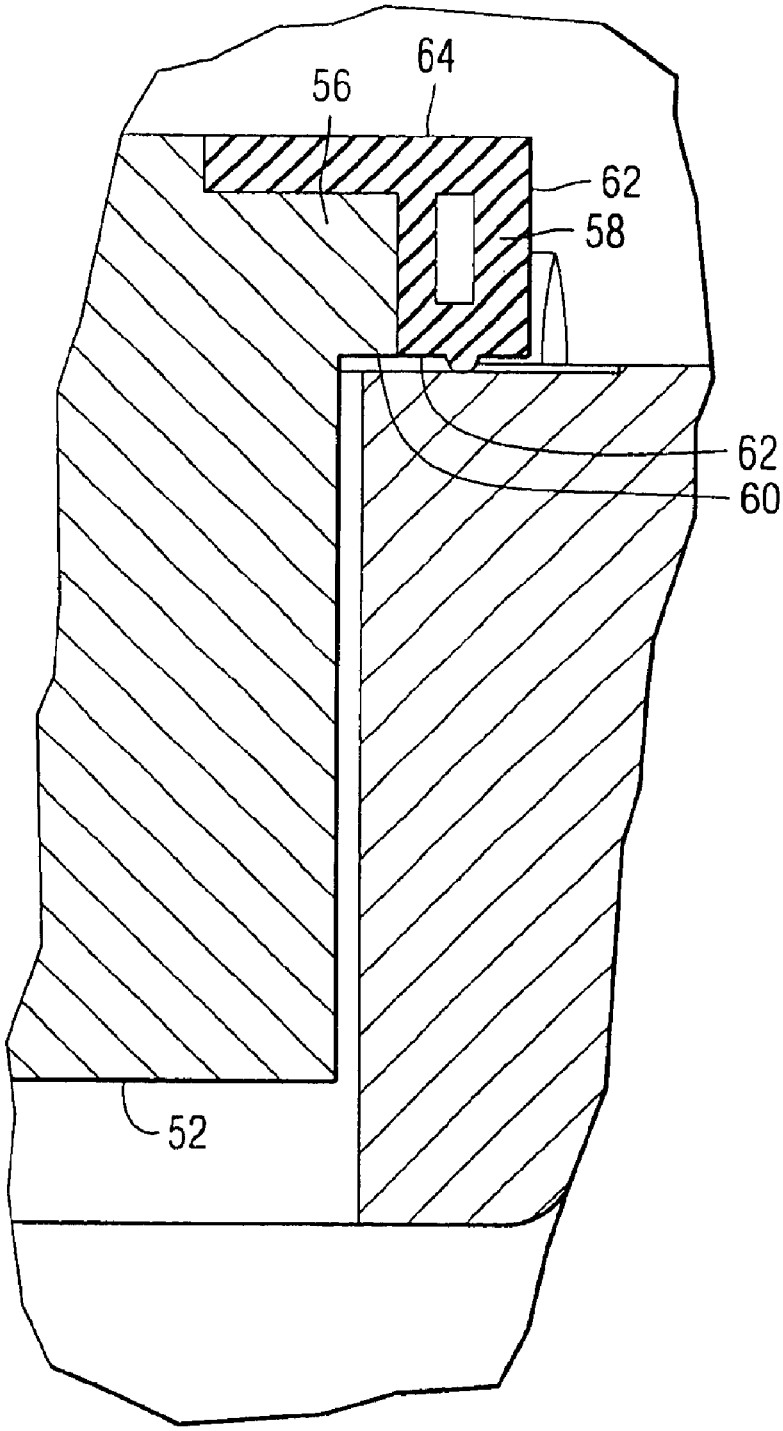
FIG. 3 is a section view of a portion of the poppet shown in FIG. 2.

The undersurface 60, shown in FIG. 3, is the actual sealing surface in a preferred embodiment of the present invention. However, in order to make the overmolded poppet 16 more robust, the resilient sealing material 58 is also formed on the edge 62 of the flange 56 and the top surface 64 of the flange. This places the resilient sealing material 58 on three surfaces of the flange 56.

Figure 4:
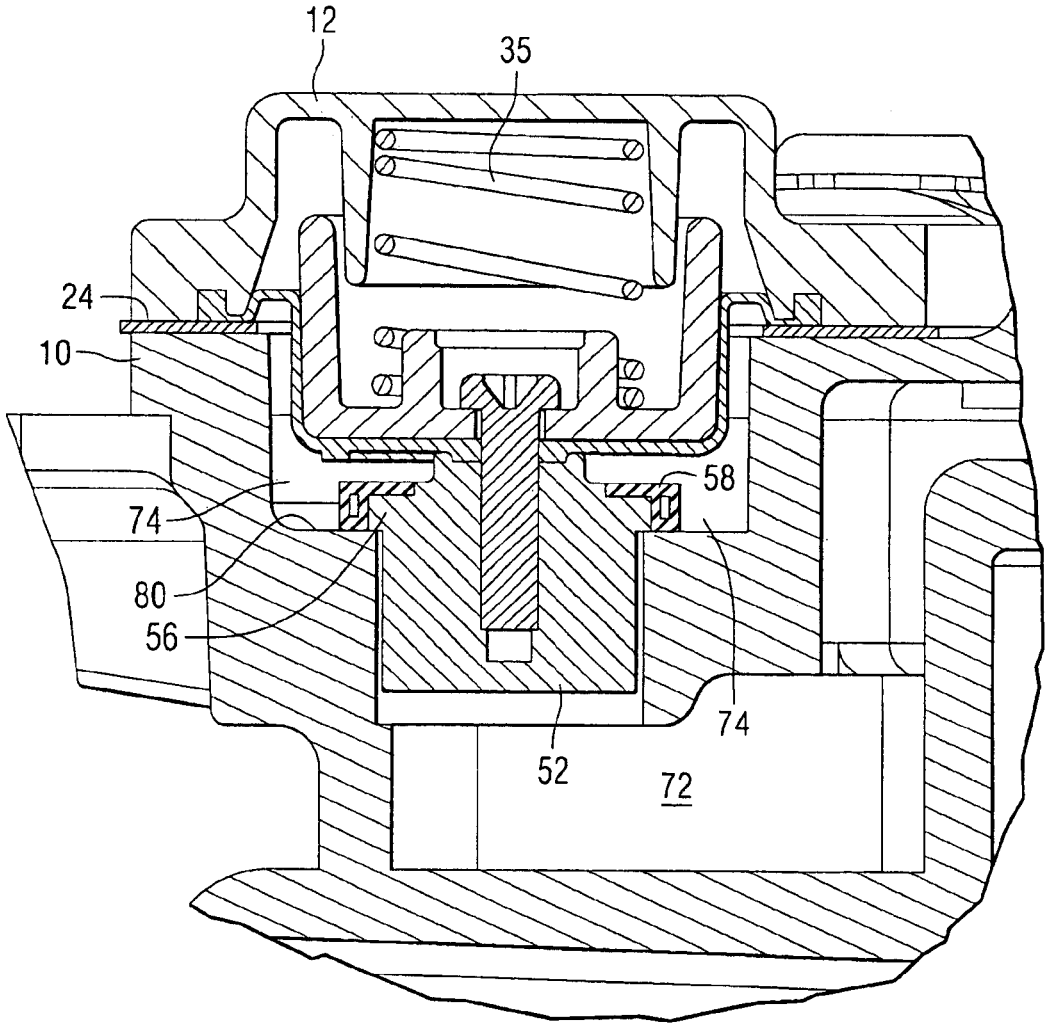
FIG. 4 is a section view of a portion of an engine in combination with the present invention.

FIG. 4 is a section view showing the cover 12 and the poppet 16. A spring 35 which serves as the pressure regulating device which urges the poppet 16 into its first position, as illustrated in FIG. 4, which blocks the flow of liquid coolant and prevents it from flowing upwardly through the conduit 70 which is disposed in fluid communication between a cooling passage 72 of the engine 10 and a drain passage 74 which directs the coolant to a discharge opening through which the coolant is returned to the body of water in which the marine vessel is operating. The resilient sealing material 58 is shown in its position where it is overmolded around the flange 56. When the poppet 16 moves downwardly into its first position, as shown in FIG. 4, the force of the spring 35 causes the undersurface 60, as described above in conjunction with FIG. 3, to seal against the sealing surface 80 formed at the downstream end of the conduit 70.

Figure 5:
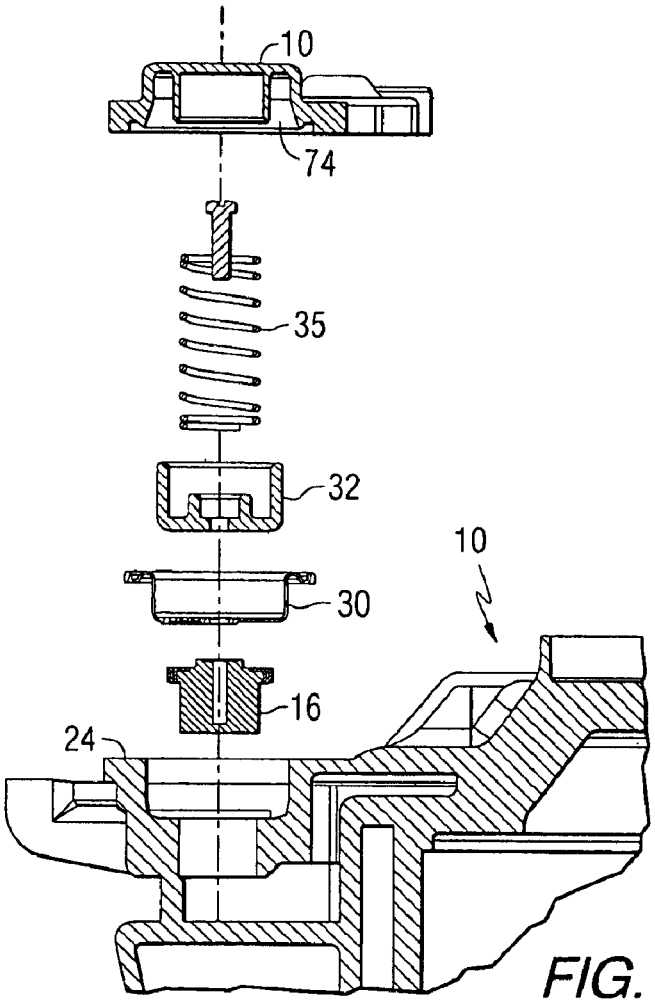
FIG. 5 is an exploded view of the portion shown in FIG. 4.

FIG. 5 is an exploded view of the arrangement shown in FIG. 4. The insertion portion 52 of the poppet 16 is shaped to be received in the conduit 70 to guide the movement of the poppet 16, in a vertical direction in FIG. 5, between its first position and second position. The first position is illustrated in FIG. 4 and, when in the second position, the poppet 16 is raised upwardly above surface 80 to allow liquid coolant to flow from the cooling passage 72, through the conduit 70, between the undersurface 60 of the flange 56 and surface 80 of the engine, and upwardly through the cover 12 to pass through the drain passage 74. This flow occurs when the pressure within the cooling passage 72 exceeds a preselected pressure that is sufficient to raise the poppet 16 against the downward force provided by the spring 35 which operates as a pressure regulating device.

With continued reference to FIGS. 1–5, it can be seen that an engine cooling system made in accordance with the preferred embodiment of the present invention, comprises a cooling passage 72 formed within an internal combustion engine 10. It also comprises a drain passage 74 and a conduit 70 that is disposed in fluid communication between the cooling passage 72 and the drain passage 74. A poppet 16 is moveable relative to the conduit 70 between a first position, shown in FIG. 4, and a second position in which the undersurface 60 of the poppet 16 is raised above surface 80 of the engine to allow coolant to pass between surface 80 and the underside 60 of the flange 56. A liquid coolant is generally prevented from flowing through the conduit 70 when the poppet 16 is in the first position, as shown in FIG. 4, and is generally permitted to flow through the conduit 70 when the poppet is in its second position. A pressure regulating device 35, such as the spring shown in FIGS. 1, 4, and 5, is associated with the poppet 16 to urge the poppet into the first position shown in FIG. 4. A resilient sealing material 58 is overmolded on a sealing portion 50 of the poppet 16. The poppet comprises the sealing portion 50 and an insertion portion 52, wherein the insertion portion 52 is shaped to be disposed within the conduit 70. The sealing portion of the poppet is a flange 56 that extends radially from a body of the poppet 16. A resilient sealing material 58 can be formed on two surfaces of the flange 56, but in a preferred embodiment of the present invention, it is formed on three surfaces.

With continued reference to FIGS. 1–5, it can be seen that the conduit 70 is generally circular in cross-section and has a radius which is measured in a generally horizontal direction in FIG. 4. The sealing portion 50 of the poppet 16 is also generally circular in cross-section. The sealing portion 50 has a greater radius than the conduit 70 to allow the underside 60 of the flange 56 to form a seal with surface 80 to prevent flow of coolant upwardly through the conduit 70 from the cooling passage 72 to the drain passage 74.

By overmolding the flange 56, an improved seal is provided between the sealing portion 50 and surface 80. In known types of cooling systems, a plastic poppet 16 is expected to seal, with its relatively hard plastic underside 60 against the sealing surface 80. Because of potential irregularities in manufacturing and as a result of the relative hardnesses of both the sealing surface 80 and the underside 60 of the poppet 16, cooling water often leaks through the conduit 70 even when the pressure within the cooling passage 72 is less than the preselected pressure that is expected to be maintained by the force of the spring 35. This allows warmed water to flow from the cooling passage 72 to the drain 74 after which it is discharged back into the body water from which it was drawn. Because of the removal of this warmed water from the cooling system of engine 10, colder water is pumped into the engine to replace the water that leaked passed the poppet 16. This creates significant difficulty in maintaining the temperature of the engine 10 at desired levels. By overmolding the flange 56 with the resilient sealing material 58, this leakage past the flange 56 is prevented and the cooling system can more accurately regulate the temperature of the cooling water within the cooling passage 72. This allows the engine to run more efficiently.

Although the present invention has been described in particular detail and illustrated to show a preferred embodiment, it should be understood that alternative embodiments are also within its scope.

We claim:

1. An engine cooling system, comprising:

a cooling passage formed within an internal combustion engine;

a drain passage;

a conduit disposed in fluid communication between said cooling passage and said drain passage;

a poppet which is movable relative to said conduit between a first position and a second position, a liquid coolant being generally prevented from flowing through said conduit when said poppet is in said first position, said liquid coolant being generally permitted to flow through said conduit when said poppet is in said second position;

a pressure regulating device associated with said poppet to urge said poppet into said first position; and a resilient sealing material overmolded on a sealing portion of said poppet, said sealing portion of said poppet being a flange extending from a body of said poppet, said resilient sealing material being formed on three surfaces of said flange.

2. The engine cooling system of claim 1, wherein:

said pressure regulating device is a metallic spring.

3. The engine cooling system of claim 1, wherein:

said poppet comprises said sealing portion and an insertion portion, said insertion portion being disposed within said conduit.

4. The engine cooling system of claim 1, wherein:

said resilient sealing material is formed on two surfaces of said flange.

5. The engine cooling system of claim 1, wherein:

said conduit is generally circular in cross section and said sealing portion is generally circular in cross section, said circular cross section of said sealing portion having a greater radius than said circular cross section of said conduit.

6. An engine cooling system, comprising:

a cooling passage formed within an internal combustion engine;

a drain passage;

a conduit disposed in fluid communication between said cooling passage and said drain passage;

a poppet which is movable relative to said conduit between a first position and a second position, a liquid coolant being generally prevented from flowing through said conduit when said poppet is in said first position, said liquid coolant being generally permitted to flow through said conduit when said poppet is in said second position, said poppet comprising a sealing portion and an insertion portion, said insertion portion being disposed within said conduit;

a pressure regulating device associated with said poppet to urge said poppet into said first position; and a resilient sealing material overmolded on said sealing portion of said poppet, said resilient sealing material being formed on three surfaces of said flange.

7. The engine cooling system of claim 6, wherein:

said sealing portion of said poppet is a flange extending from a body of said poppet.

8. The engine cooling system of claim 7, wherein:

said resilient sealing material is formed on two surfaces of said flange.

9. The engine cooling system of claim 8, wherein:

said pressure regulating device is a metallic spring.

10. The engine cooling system of claim 9, wherein:

said conduit is generally circular in cross section and said sealing portion is generally circular in cross section, said circular cross section of said sealing portion having a greater radius than said circular cross section of said conduit.

11. An engine cooling system, comprising:

a cooling passage formed within an internal combustion engine;

a drain passage;

a conduit disposed in fluid communication between said cooling passage and said drain passage;

a poppet which is movable relative to said conduit between a first position and a second position, a liquid coolant being generally prevented from flowing through said conduit when said poppet is in said first position, said liquid coolant being generally permitted to flow through said conduit when said poppet is in said second position, said poppet comprising a sealing portion and an insertion portion, said insertion portion being disposed within said conduit;

a pressure regulating device associated with said poppet to urge said poppet into said first position; and a resilient sealing material overmolded on said sealing portion of said poppet, said sealing portion of said poppet being a flange extending from a body of said poppet, said resilient sealing material being formed on three surfaces of said flange.

12. The engine cooling system of claim 11, wherein:

said resilient sealing material is formed on two surfaces of said flange.

13. The engine cooling system of claim 12, wherein:

said conduit is generally circular in cross section and said sealing portion is generally circular in cross section, said circular cross section of said sealing portion having a greater radius than said circular cross section of said conduit.

14. The engine cooling system of claim 13, wherein:

said pressure regulating device is a metallic spring.

* * * * *